US006896160B2

(12) United States Patent
Kaufman et al.

(10) Patent No.: US 6,896,160 B2
(45) Date of Patent: May 24, 2005

(54) LOCKABLE DISC TOP DISPENSING CLOSURE

(75) Inventors: Brett Kaufman, Newburgh, IN (US); John Tauber, Edgewood, MD (US); Frank Cassidy, Port Deposit, MD (US)

(73) Assignee: Poly-Seal Corporation, Baltimore, MD (US)

( * ) Notice: Subject to any disclaimer, the term of this patent is extended or adjusted under 35 U.S.C. 154(b) by 0 days.

(21) Appl. No.: 10/317,224

(22) Filed: Dec. 12, 2002

(65) Prior Publication Data

US 2004/0112927 A1 Jun. 17, 2004

(51) Int. Cl.[7] ..... B67B 5/00
(52) U.S. Cl. ..... 222/153.14; 222/536; 215/235
(58) Field of Search ..... 222/153.14, 531–536, 222/556; 215/235

(56) References Cited

U.S. PATENT DOCUMENTS

| | | | | |
|---|---|---|---|---|
| 4,047,643 A | * | 9/1977 | Hazard | 222/153.14 |
| 4,548,331 A | * | 10/1985 | Montgomery | 220/253 |
| 4,763,801 A | * | 8/1988 | Nycz | 215/203 |
| 4,838,460 A | | 6/1989 | Moore et al. | |
| 5,236,107 A | | 8/1993 | Spaanstra, Sr. | |
| 5,279,451 A | | 1/1994 | Mueller et al. | |
| 5,284,264 A | | 2/1994 | Gross | |
| 5,314,093 A | | 5/1994 | Gross et al. | |
| 5,341,960 A | | 8/1994 | Lay | |
| 5,379,926 A | | 1/1995 | Mueller et al. | |
| 5,622,284 A | | 4/1997 | Sawicki | |
| 5,797,521 A | * | 8/1998 | Sobral | 222/531 |
| 6,029,866 A | | 2/2000 | Wood et al. | |
| 6,152,329 A | | 11/2000 | Rosenthal et al. | |
| 6,343,725 B1 | | 2/2002 | Lohrman | |
| 6,394,323 B2 | | 5/2002 | McClean et al. | |
| 6,431,416 B1 | * | 8/2002 | Lohrman | 222/536 |

* cited by examiner

*Primary Examiner*—Gene Mancene
*Assistant Examiner*—Patrick Buechner
(74) *Attorney, Agent, or Firm*—Dickstein Shapiro Morin & Oshinsky LLP

(57) ABSTRACT

A disc top dispensing closure which includes a body having an opening and an actuator having a channel mounted to the closure body. The actuator is pivotable between an open position, wherein the channel and the opening of the body form a continuous fluid path, and a closed position, wherein the channel and the opening of the body do not form a continuous fluid path. The actuator is also rotatable between a locked position, wherein the actuator is not movable between the open and the closed position, and an unlocked position, wherein the actuator is movable between the open and the closed position.

43 Claims, 5 Drawing Sheets

LOCKABLE DISC TOP DISPENSING CLOSURE

BACKGROUND

The present invention is directed to packages for dispensing fluid products, and more particularly to a package having a dispensing closure which is lockable so as to prevent the accidental opening of the closure.

Fluid dispensing closures typically include a base which is secured to the neck of a container, and an actuator disc pivotally mounted on the base. The disc is capable of being pivoted between a closed position that closes a dispensing opening in the closure base, and an open position that allows for dispensing a fluid product from the container.

A disadvantage with the above-described closures is that a relatively small amount of force is needed to pivot the disc from the closed position to the open position and thus, these type of closures can readily accidentally open and spill the contents of the container either during shipping to the consumer or when packed for travel by the consumer. The latter problem is particularly annoying to consumers as they discover that their packed containers have opened and spilled their contents within their travel bags.

There are many types of lockable dispensing closures available. Typically, however, these closures only address the problem of preventing leakage during shipping to the consumer. Generally, with these locking closures, the locking feature is either removed or rendered ineffective after the first use by the consumer, or it requires more than two pieces.

Accordingly, there is a need for a dispensing closure which can prevent leakage during the shipping to the consumer and that can be repeatedly used when the container is packed for travel by the consumer.

SUMMARY

In accordance with a preferred embodiment of the present invention, a dispensing package is provided that includes a container defining a chamber and having an orifice in fluid communication with the chamber and a closure mounted on the container. The closure includes a body that includes an opening, which is located so as to be in fluid communication with the orifice of the container, and an actuator. The actuator is mounted to the closure body and has a channel formed therein. The actuator is pivotable between an open position wherein the channel and the opening of the body form a continuous fluid path with the chamber of the container and a closed position wherein the channel and the opening of the body do not form a continuous fluid path. Further, the actuator is rotatable between a locked position, wherein the actuator is not movable between the open and the closed position, and an unlocked position, wherein the actuator is movable between the open and the closed position.

In accordance with an aspect of the present invention, the body further includes a groove extending circumferentially along an interior portion of the body, and the actuator further includes at least one protrusion engageable with the groove and movable along the groove so as to facilitate rotation of the actuator between the locked position and the unlocked position. In addition, the body preferably includes a recess, and the actuator preferably includes a tab extending outward from the actuator for cooperation with the recess of the body such that when the tab and the recess are aligned the actuator is pivotable between the closed position and the open position, and when the tab and the recess are not aligned the actuator is not pivotable between the closed position and the open position.

In another aspect of the present invention, the body includes an upwardly extending annular rim which defines the opening of the body, and the actuator includes a downwardly extending annular rim which seats within an inner circumference of the upwardly extending annular rim so as to form a seal between the opening of the body and the channel of the actuator when the actuator is in the closed position. Preferably, the upwardly extending annular rim is centered relative to the body and an axis of rotation of the actuator corresponds to a center axis of the annular rim so as to facilitate rotation of the actuator between the locked and unlocked positions.

When the consumer is ready to initially open the package constructed according to a preferred embodiment of the present invention, the consumer first rotates the actuator into the unlocked position such that the tab is aligned with the recess. Then, the consumer places the actuator in the open position by pressing downwardly on an edge of the actuator. Since the tab is designed to fit within the recess when the actuator is placed in the open position, the tab and/or recess are not destroyed or deformed during the initial opening by the consumer. Because of this, after the consumer initially opens the package, the closure can be returned to the locked position by reversing the above steps and placing the aperture in the locked position. Therefore, the closure of the present invention can be used by the consumer to prevent further unwanted opening of the closure after the initial shipment to the consumer, such as when the package is packed for travel by the consumer.

These and other aspects and features of the invention will become apparent from the following detailed description of the invention.

DETAILED DESCRIPTION OF PREFERRED EMBODIMENTS

Figure 1:
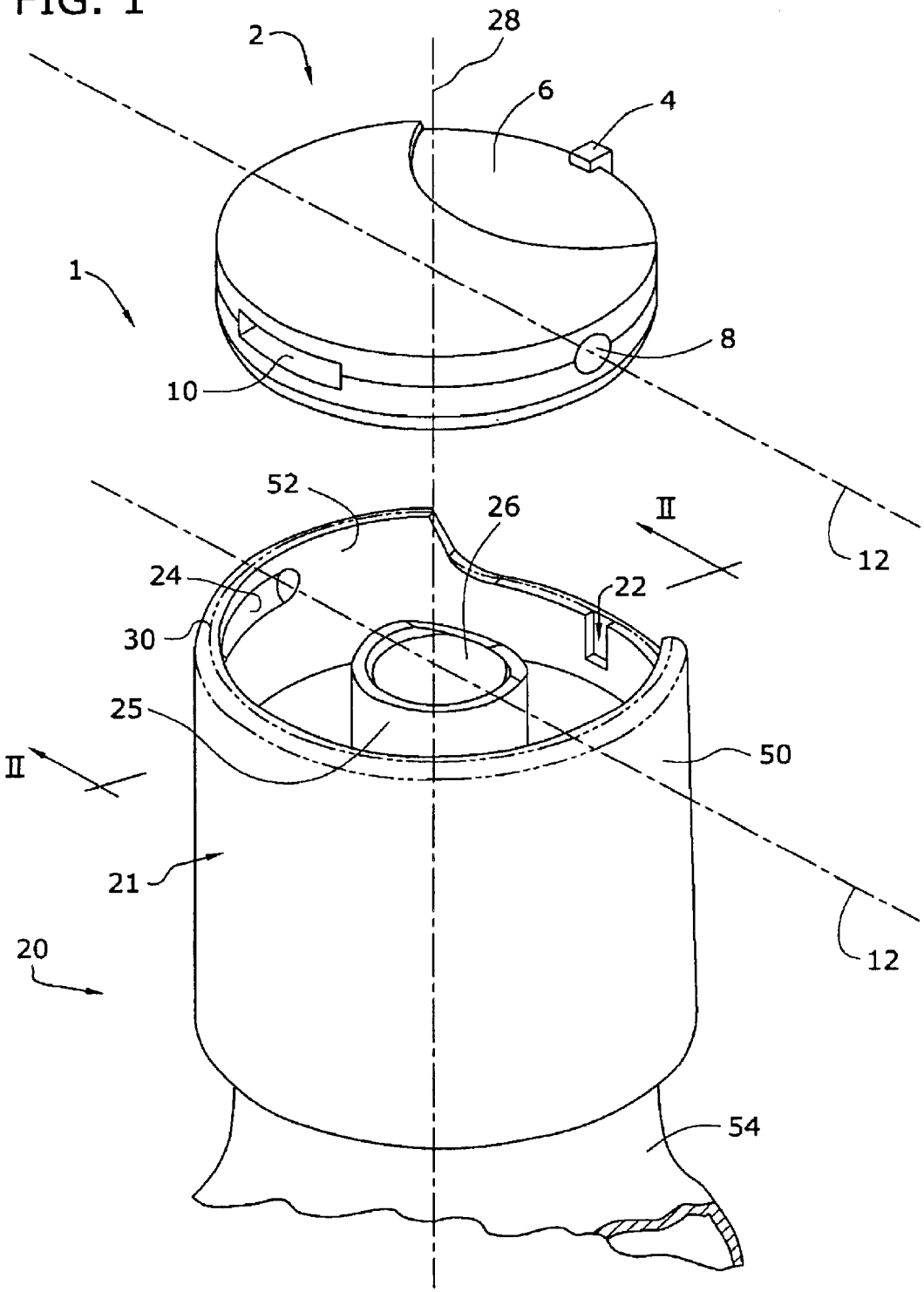
FIG. 1 is an exploded perspective view of a locking closure according to a preferred embodiment of the present invention.

Referring now to the drawings, FIGS. 1–8 illustrate a dispensing package 1 in accordance with a preferred embodiment of the present invention. The dispensing package 1 includes a closure 20 having a body 21 mounted on a container 54. The container 54 defines a chamber 55 and has an orifice 57 in fluid communication with the chamber such that the contents of the chamber can be dispensed through the orifice. The container 54 may be of any suitable material and construction, such as a flexible resilient molded plastic. Preferably, the closure body 21 has a peripheral skirt 50 with an internal thread 40 (FIGS. 2, 3) that cooperates with an external thread (not shown) on a neck of the container 54 to secure the closure body 21 to the container 54 as shown in FIGS. 1–5. However, as will be readily apparent to one skilled in the art, the closure 20 may be secured to the container by any known mounting finish, such as a lug-style finish or a snap-on finish, to name a few.

Figure 3:
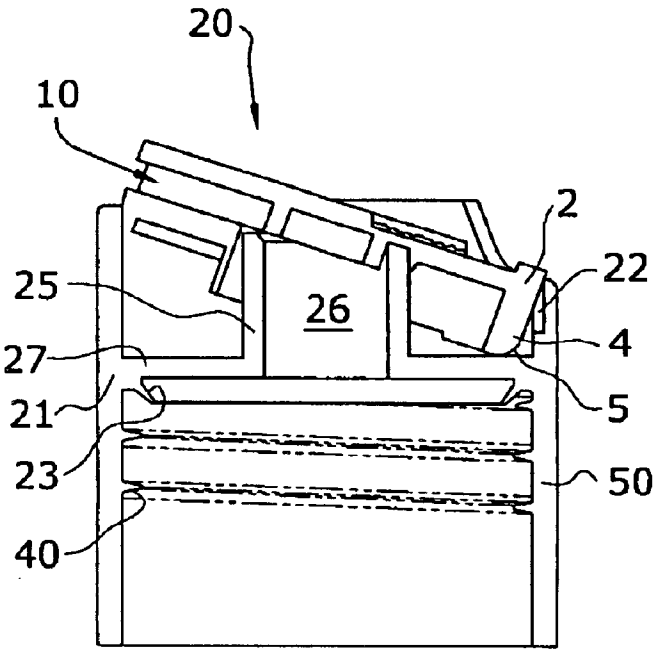
FIG. 3 is a view like FIG. 2 showing the closure in the open position.
Figure 2:
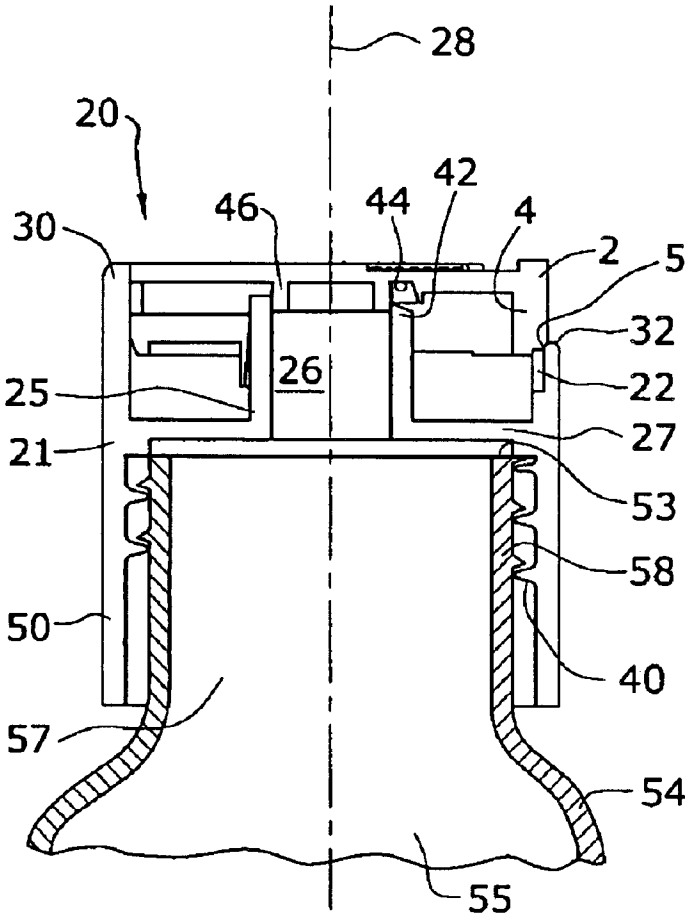
FIG. 2 is a cross-sectional view along line II—II of FIG. 1 showing the closure in the closed position.
Figure 5:
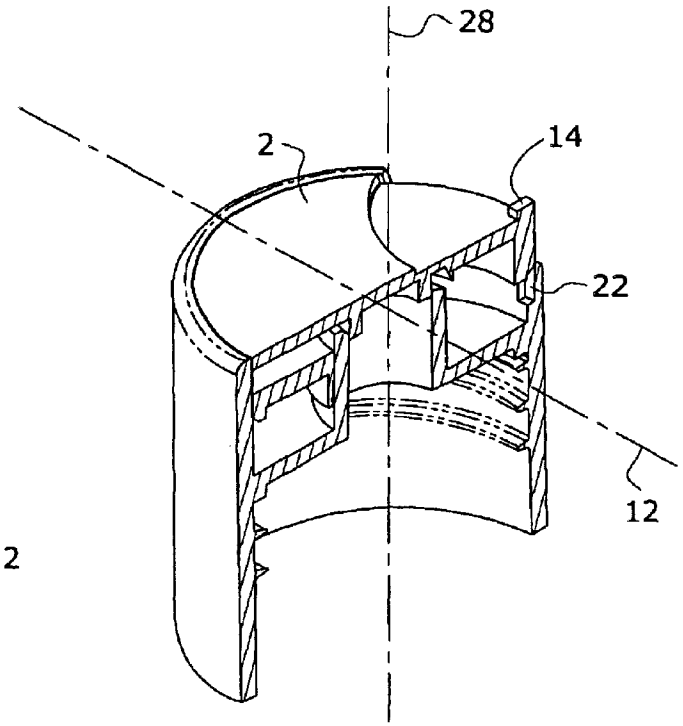
FIG. 5 is a cross-sectional, perspective view of the closure shown in FIG. 2.
Figure 4:
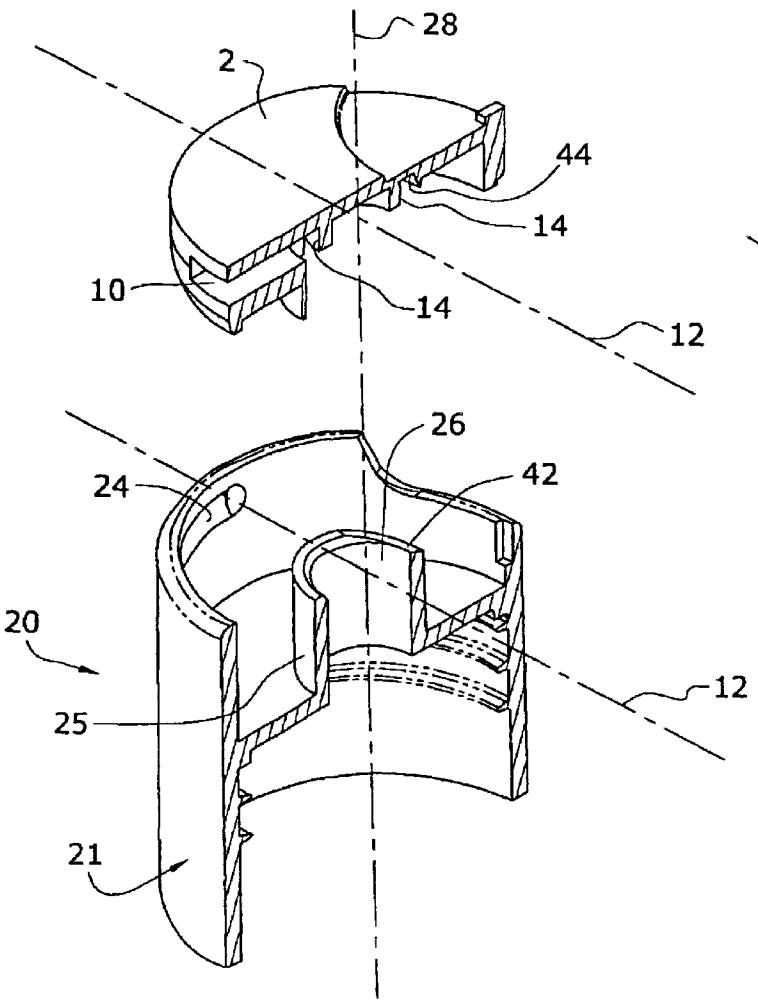
FIG. 4 is a cross-sectional, exploded perspective view of the closure shown in FIG. 1.
Figure 7:
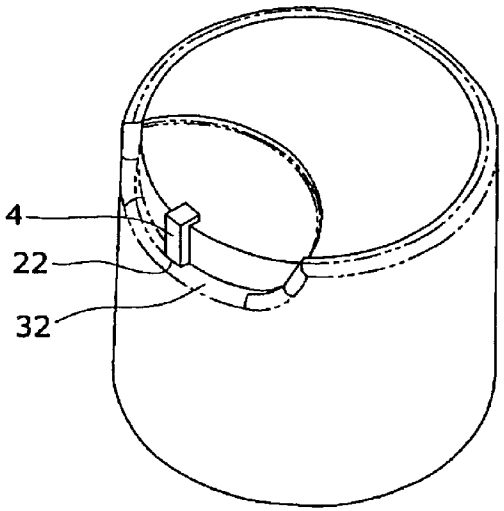
FIG. 7 is perspective view of the closure of FIG. 1 in the unlocked position.

As shown in FIGS. 2 and 3, a sealing platform 27 is disposed beneath an upper edge 30 of the closure body 21, and has an opening 26 which is in fluid communication with the orifice 57 of the container 54 for dispensing product from within the container. The sealing platform 27 is designed to seat against the land area 53 of the neck 58 of the container 54 and prevent leakage of the product from the container 54 and onto the threaded finish. The sealing function of the sealing platform 27 may be accomplished through a linerless feature 23 (FIG. 3). Although FIGS. 2 and 3 show a sealing platform 27 which directly abuts the land area of the container neck, one of skill in the art should appreciate that other seals, such as valve seals or seals formed with a sealing washer for example, may instead be used.

An actuator 2 is mounted to the closure body 21 and includes a channel 10 through which the contents of the container 54 are dispensed. The actuator 2 is pivotable about an axis 12 between an open position (FIG. 3), wherein the channel 10 and the opening 26 of the closure body 21 form a continuous fluid path with the chamber of the container 54, and a closed position (FIG. 2), wherein the channel 10 and the opening 26 of the closure body 21 do not form a continuous fluid path. In addition to being pivotable about the axis 12, the actuator 2 is rotatable about an axis 28 between a locked position, wherein the actuator 2 is not movable between the open and the closed position, and an unlocked position, wherein the actuator 2 is movable between the open and the closed position. Preferably, at a location opposite the opening of channel 10, the actuator 2 includes a recessed portion 6 for manually pivoting the actuator 2 into the open position.

Figure 9:
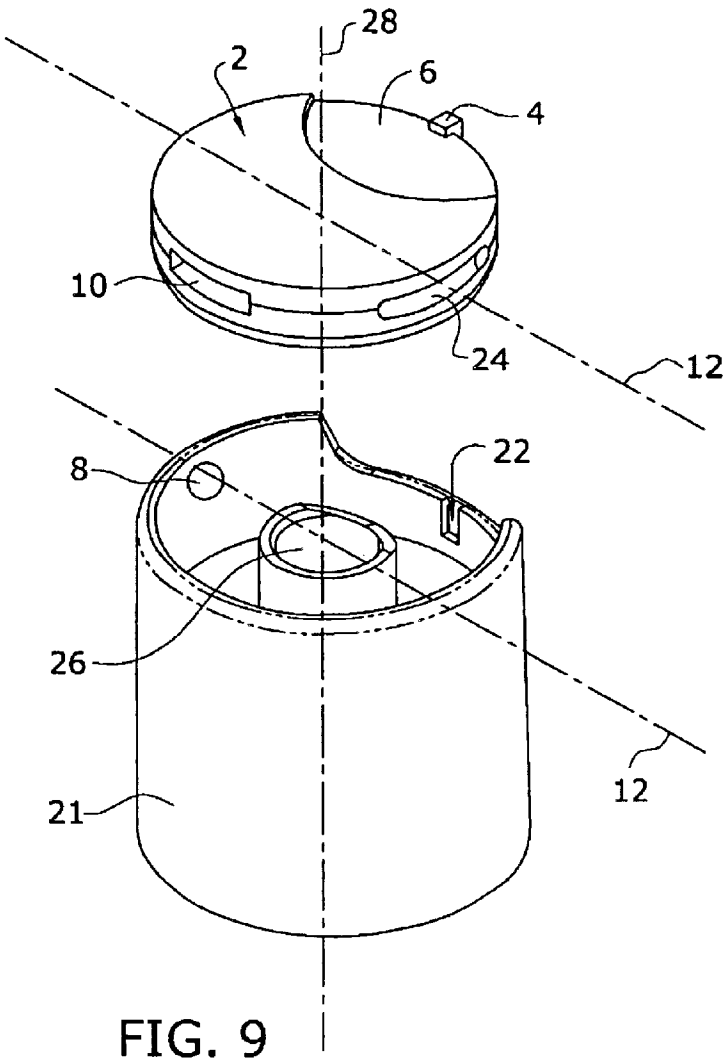
FIG. 9 is an exploded perspective view of a locking closure according to another preferred embodiment of the present invention.

In the illustrated embodiment, the closure body 21 includes at least one race 24 which circumfurentially extends along an inner portion 52 of the closure body 21, and the actuator 2 includes at least one protrusion 8 which engages with the race 24 and is movable within the race 24. Preferably, the actuator 2 includes two diametrically opposed protrusions 8 and the closure body 21 includes two corresponding diametrically opposed races 24. The protrusions 8 are preferably in a plane with the axis 12. The protrusion 8 and the race 24 are dimensioned such that when the protrusion 8 is positioned within the race 24 the actuator 2 can pivot about the axis 12, and the protrusion 8 can slide within the race 24 so as to facilitate rotation of the actuator 2 about the axis 28 between the locked position and the unlocked position. While the protrusions 8 and the races 24 are shown on, respectively, the actuator 2 and the inner surface of the closure body 21, in FIGS. 1 and 4, it should be appreciated that the protrusions 8 can be positioned on the inner surface of the closure body 21 and the races 24 can be formed on the actuator 2 (FIG. 9).

As shown in greater detail in FIGS. 2 and 3, the opening 26 of the closure body 21 is defined by an upwardly extending annular rim 25. The actuator 2 includes a downwardly extending annular rim 46 which seats within an inner circumference of the upwardly extending annular rim 25 so as to form a seal between the opening 26 of the body and the channel 10 of the actuator 2 when the actuator 2 is in the closed position as shown in FIG. 2. The downwardly extending annular rim 46 is dimensioned such that, when the actuator 2 is in the open position, as shown in FIG. 3, the downwardly extending annular rim 46 and the upwardly extending annular rim 25 separate from each other and the opening 26 of the closure body 21 and the channel 10 of the actuator 2 form a continuous fluid pathway.

Preferably, the opening 26, the upwardly extending annular rim 25 of the closure body 21 and the downwardly extending annular rim 46 of the actuator 2 are centered relative to the closure body 21 so as to facilitate rotation of the actuator 2 about the axis 28 (i.e., the axis of rotation 28 of the actuator 2 corresponds to the center axis of the opening 26).

In addition, the actuator 2 preferably includes a notch 44 adjacent the downwardly extending annular rim 46, and the upwardly extending annular rim 25 includes a beveled portion 42 on a section of the rim 25 corresponding to the notch 44. The beveled portion 42 is designed to engage with the notch 44 when the actuator 2 is placed in the open position so as to provide for a greater degree of pivot of the actuator 2 about the axis 12.

Figure 6:
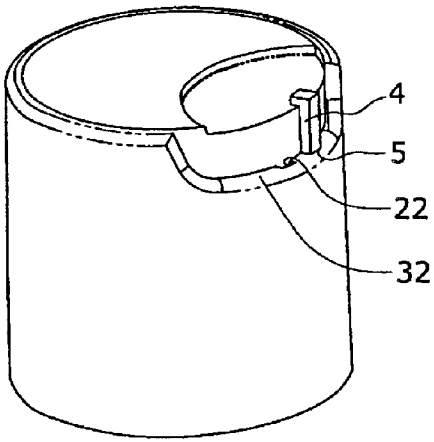
FIG. 6 is a perspective view of the closure of FIG. 1 in the locked position.
Figure 8:
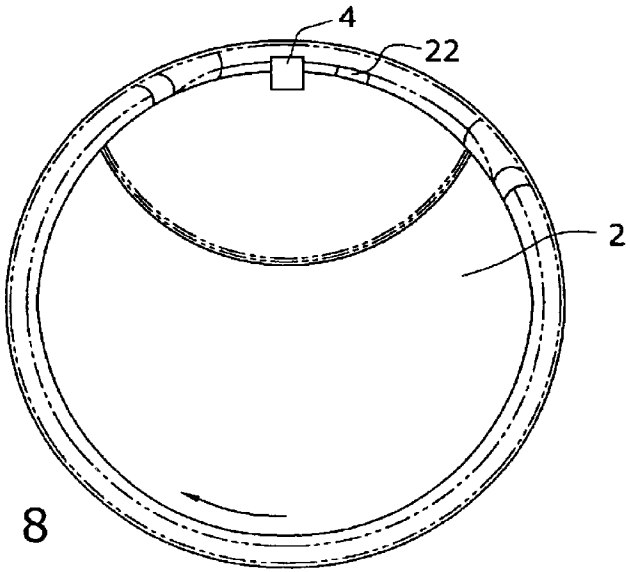
FIG. 8 is a top plan view of the closure shown in FIG. 6.
Figure 10:
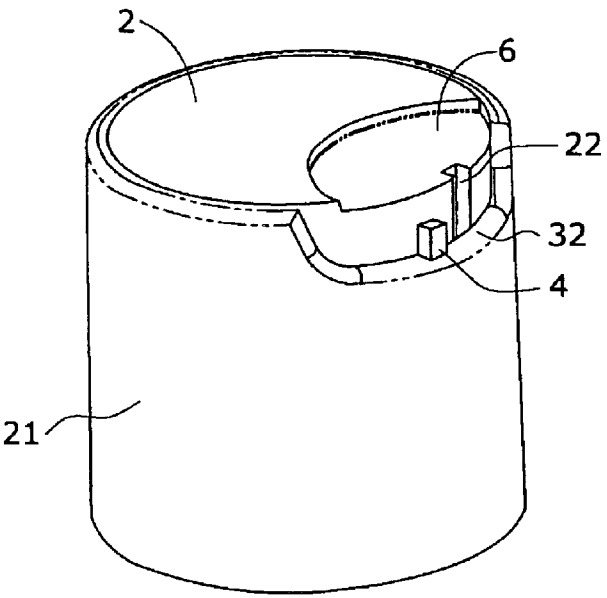
FIG. 10 is a perspective view of a locking closure according to another preferred embodiment of the present invention.

To prevent the actuator 2 from being inadvertently placed in the open position, the closure body 21 is provided with a recess 22 in the inner portion 52 of the closure body 21, and the actuator 2 is provided with a corresponding tab 4 which extends outward from the actuator 2. The tab 4 and the recess 22 cooperate with each other such that when the tab 4 and the recess 22 are aligned, the actuator 2 is pivotable about the axis 12 between the closed position (FIG. 2) and the open position (FIG. 3). When the tab 4 and the recess 22 are not aligned, the actuator 2 is not pivotable about the axis 12 between the closed position and the open position because a bottom surface 5 of the tab 4 rests against an abutting surface 32 of the closure body 21 as shown in FIGS. 6 and 8. Preferably, the abutting surface 32 is formed as a cut-out portion, which is preferably dimensioned to accept the finger of a user of the dispensing package 1. While the channel 10 is shown to be directly opposite from the tab 4 and at about ninety degrees from each protrusion 8, it should be appreciated that the channel 10 can be offset from the illustrated position. Although the tab 4 and the recess 22 are shown in FIGS. 1–8 to be positioned, respectively, on the actuator 2 and the closure body 21, it should be appreciated that the tab 4 can instead be on the closure body 21 and the recess 22 can be formed on the actuator 2 (FIG. 10). Further, it should be appreciated that the tab 4 and the recess 22 can have any suitable geometry.

When the actuator 2 is in the closed position, the bottom surface 5 of the tab 4 resting against the abutting surface 32 of the closure body 21 prevents the accidental pivoting of the actuator 2 into the open position during shipment and handling of the dispensing package 1 prior to delivery to the consumer. When the consumer is ready to initially open the dispensing package 1, the consumer first rotates the actuator 2 into the unlocked position such that the tab 4 is aligned with the recess 22. Then, the consumer places the actuator 2 in the open position by pressing downwardly on the edge of the actuator 2 overlying the cut-out portion 33. With this, the tab 4 fits within the recess 22. Since the tab 4 is designed to fit within recess 22 when the actuator 2 is placed in the open position, the tab 4 and/or recess 22 are not destroyed or deformed during the initial or subsequent openings by the consumer. Because of this, after the consumer initially opens the dispensing package 1, the closure body 21 can be returned to the locked position by reversing the above steps and placing the actuator 2 in the locked position. Therefore, the closure 20 can be used by the consumer to prevent further unwanted opening of the dispensing package 1 after the initial shipment to the consumer, such as when the dispensing package 1 is packed for travel by the consumer.

It should be appreciated that the dispensing package 1 can be formed through injection molding or other suitable processing. Further, it should be appreciated that bi-injection molding or co-injection molding, the process of injection molding in separate steps and with separate materials, may be utilized to form the dispensing package 1. For example, the co-injection molding may be used in such a manner to assist the consumer in identifying various aspects and functions of the dispensing package 1. The co-injection molding further may be used to allow different strength materials to be used in different areas of the dispensing package 1, allowing for enhanced performance.

While the invention has been described in detail in connection with exemplary embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A closure comprising:

a body having an opening; and an actuator mounted to the body and having a channel;

wherein the actuator is pivotable between an open position and a closed position and wherein the actuator is rotatable between a locked position in which the actuator is locked against movement between the open and the closed position and an unlocked position in which the actuator is movable between the open and the closed position.

2. The closure according to claim 1, wherein in the open position the channel and the opening of the body form a continuous fluid path and in the closed position the channel and the opening of the body do not form a continuous fluid path.

3. The closure according to claim 1, wherein the opening is centered relative to the body and an axis of rotation of the actuator corresponds to a center axis of the opening.

4. The closure according to claim 1, wherein the body further includes a race extending circumferentially along an interior portion of the body, and the actuator further includes at least one protrusion engageable with the race and movable along the race so as to facilitate rotation of the actuator between the locked position and the unlocked position.

5. The closure according to claim 1, wherein the actuator further includes a race extending circumferentially along an exterior portion of the actuator, and the body further includes at least one protrusion engageable with the race and movable along the race so as to facilitate rotation of the actuator between the locked position and the unlocked position.

6. The closure according to claim 5, wherein said actuator is pivotable about said protrusions.

7. The closure according to claim 6, wherein said protrusions are aligned along a pivot axis.

8. The closure according to claim 1, wherein the actuator further includes a recess, the body further including a tab extending inward from the body for cooperation with the recess of the actuator such that when the tab and the recess are aligned the actuator is pivotable between the closed position and the open position, and when the tab and the recess are not aligned the actuator is hindered from pivoting between the closed position and the open position.

9. The closure according to claim 1, wherein the body further includes a recess, the actuator further including a tab extending outward from the actuator for cooperation with the recess of the body such that when the tab and the recess are aligned the actuator is pivotable between the closed position and the open position, and when the tab and the recess are not aligned the actuator is hindered from pivoting between the closed position and the open position.

10. The closure according to claim 9, wherein the body includes a cut-out portion, the recess being located in the cut-out portion.

11. The closure according to claim 1, wherein the body includes an upwardly extending annular rim which defines the opening of the body, and the actuator includes a downwardly extending annular rim which seats within an inner circumference of the upwardly extending annular rim forming a seal between the opening of the body and the channel of the actuator when the actuator is in the closed position.

12. The closure according to claim 11, wherein the actuator includes a notch on a lower surface thereof and the upwardly extending annular rim includes a beveled portion which engages with the notch when the actuator is in the open position.

13. The closure according to claim 11, wherein the upwardly extending annular rim is centered relative to the body and an axis of rotation of the actuator corresponds to a center axis of the annular rim.

14. The closure according to claim 1, wherein the body further includes a finish for attachment to a container.

15. The closure according to claim 14, wherein the finish is a threaded finish.

16. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the closure body and having a channel, the actuator being pivotable between an open position and a closed position and wherein the actuator is rotatable between a locked position in which the actuator is locked against movement between the open and the closed position and an unlocked position in which the actuator is movable between the open and the closed position.

17. The dispensing package according to claim 16, wherein in the open position the channel and the opening of the body form a continuous fluid path with the chamber of the container and in the closed position the channel and the opening of the body do not form a continuous fluid path.

18. The dispending package according to claim 16, wherein the opening of the body is centered relative to the body and an axis of rotation of the actuator corresponds to a center axis of the opening.

19. The dispensing package according to claim 16, wherein the body further includes a race extending circumferentially along an interior portion of the body, and the actuator further includes at least one protrusion engageable with the race and movable along the race so as to facilitate rotation of the actuator between the locked position and the unlocked position.

20. The dispending package according to claim 16, wherein the actuator further includes a race extending circumferentially along an exterior portion of the body, and the body further includes at least one protrusion engageable with the race and movable along the race so as to facilitate rotation of the actuator between the locked position and the unlocked position.

21. The dispending package according to claim 16, wherein the actuator further includes a recess and the body further includes a tab extending inward from the body for cooperation with the recess of the actuator such that when the tab and the recess are aligned the actuator is pivotable between the closed position and the open position, and when the tab and the recess are not aligned the actuator is not pivotable between the closed position and the open position.

22. The dispensing package according to claim 16, wherein the body further includes a recess and the actuator further includes a tab extending outward from the actuator for cooperation with the recess of the body such that when the tab and the recess are aligned the actuator is pivotable between the closed position and the open position, and when the tab and the recess are not aligned the actuator is not pivotable between the closed position and the open position.

23. The dispensing package according to claim 22, wherein the body includes a cut-out portion and the recess is located in the cut-out portion.

24. The dispensing package according to claim 16, wherein the body includes an upwardly extending annular rim which defines the opening of the body, and the actuator includes a downwardly extending annular rim which seats within an inner circumference of the upwardly extending annular rim to form a seal between the opening of the body and the channel of the actuator when the actuator is in the closed position.

25. The dispensing package according to claim 24, wherein the actuator includes a notch on a lower surface thereof and the upwardly extending annular rim includes a beveled portion which engages with the notch when the actuator is in the open position.

26. The dispending package according to claim 24, wherein the upwardly extending annular run is centered relative to the body and an axis of rotation of the actuator corresponds to a center axis of the annular rim.

27. The dispensing package according to claim 16, wherein the body and the container include complementary finishes for mounting of the closure on the container.

28. The dispensing package according to claim 27, wherein the complementary finishes are threaded finishes.

29. A method for discharging contents from a container, the method comprising:

providing a container closure having an actuator which is pivotable between an open position and a closed position and rotatable between a locked position in which the actuator is locked against movement between the open and the closed position and an unlocked position in which the actuator is movable between the open and the closed position;

rotating the actuator into the unlocked position; and pivoting the actuator into the open position such that the contents of the container can be discharged.

30. The method for discharging contents from a container according to claim 29, wherein in the open position the contents of the container are capable of being discharged and in the closed position the contents of the container are not capable of being discharged.

31. The method for discharging contents from a container according to claim 29, further comprising pivoting the actuator into the closed position after the discharge of the contents from the container.

32. The method for discharging the contents from a container according to claim 31, further comprising rotating the actuator into the locked position so as to prevent the pivoting of the actuator into the open position.

33. A closure comprising:

a body having an opening;

wherein the opening is centered relative to the body and an axis of rotation of the actuator corresponds to a center axis of the opening; and an actuator mounted to the body and having a channel;

wherein the actuator is pivotable between an open position and a closed position and wherein the actuator is rotatable between a locked position and an unlocked position.

34. A closure comprising:

a body having an opening; and an actuator mounted to the body and having a channel;

wherein the actuator is pivotable between an open position and a closed position and wherein the actuator is rotatable between a locked position and an unlocked position; and wherein the body includes a race extending circumferentially along an interior portion of the body, and the actuator includes at least one protrusion engageable with the race and movable along the race so as to facilitate rotation of the actuator between the locked position and the unlocked position.

35. A closure comprising:

a body having an opening; and an actuator mounted to the body and having a channel;

wherein the actuator is pivotable between an open position and a closed position and wherein the actuator is rotatable between a locked position and an unlocked position; and wherein the actuator includes a race extending circumferentially along an exterior portion of the actuator, and the body includes at least one protrusion engageable with the race and movable along the race so as to facilitate rotation of the actuator between the locked position and the unlocked position.

36. A closure comprising:

a body having an opening; and an actuator mounted to the body and having a channel;

wherein the actuator is pivotable between an open position and a closed position and wherein the actuator is rotatable between a locked position and an unlocked position; and wherein the actuator includes a recess, the body including a tab extending inward from the body for cooperation with the recess of the actuator such that when the tab and the recess are aligned the actuator is pivotable between the closed position and the open position, and when the tab and the recess are not aligned the actuator is hindered from pivoting between the closed position and the open position.

37. A closure comprising:

a body having an opening; and an actuator mounted to the body and having a channel;

wherein the actuator is pivotable between an open position and a closed position and wherein the actuator is rotatable between a locked position and an unlocked position; and wherein the body further includes a recess, the actuator further including a tab extending outward from the actuator for cooperation with the recess of the body such that when the tab and the recess are aligned the actuator is pivotable between the closed position and the open position, and when the tab and the recess are not aligned the actuator is hindered from pivoting between the closed position and the open position.

38. A dispensing package comprising:

a container defining a chamber and having an orifice in fluid communication with the chamber; and a closure mounted on the container, the closure comprising:

a body having an opening, the opening located to be in fluid communication with the orifice of the container;

wherein the opening is centered relative to the body and an axis of rotation of the actuator corresponds to a center axis of the opening; and an actuator mounted to the closure body and having a channel, the actuator being pivotable between an open position and a closed position and wherein the actuator is rotatable between a locked position and an unlocked position.

39. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the closure body and having a channel, the actuator being pivotable between an open position and a closed position and wherein the actuator is rotatable between a locked position and an unlocked position;

wherein the body further includes a race extending circumferentially along an interior portion of the body, and the actuator further includes at least one protrusion engageable with the race and movable along the race so as to facilitate rotation of the actuator between the locked position and the unlocked position.

40. A dispensing package comprising:

a container defining a chamber and having an orifice in fluid communication with the chamber; and a closure mounted on the container, the closure comprising:

a body having an opening the opening located to be in fluid communication with the orifice of the container; and an actuator mounted to the closure body and having a channel, the actuator being pivotable between an open position and a closed position and wherein the actuator is rotatable between a locked position and an unlocked position;

wherein the actuator further includes a race extending circumferentially along an exterior portion of the body, and the body further includes at least one protrusion engageable with the race and movable along the race so as to facilitate rotation of the actuator between the locked position and the unlocked position.

41. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the closure body and having a channel, the actuator being pivotable between an open position and a closed position and wherein the actuator is rotatable between a locked position and an unlocked position;

wherein the actuator further includes a recess and the body further includes a tab extending inward from the body for cooperation with the recess of the actuator such that when the tab and the recess are aligned the actuator is pivotable between the closed position and the open position, and when the tab and the recess are not aligned the actuator is not pivotable between the closed position and the open position.

42. A dispensing package comprising:

a container defining a chamber and having an orifice in fluid communication with the chamber; and a closure mounted on the container, the closure comprising:

a body having an opening, the opening located to be in fluid communication with the orifice of the container; and an actuator mounted to the closure body and having a channel, the actuator being pivotable between an open position and a closed position and wherein the actuator is rotatable between a locked position and an unlocked position;

wherein the body further includes a recess and the actuator further includes a tab extending outward from the actuator for cooperation with the recess of the body such that when the tab and the recess are aligned the actuator is pivotable between the closed position and the open position, and when the tab and the recess are not aligned the actuator is not pivotable between the closed position and the open position.

43. A method for discharging contents from a container, the method comprising:

providing a container closure having an actuator which is pivotable between an open position and a closed position and rotatable between a locked position and an unlocked position;

rotating the actuator into the unlocked position;

pivoting the actuator into the open position such that the contents of the container can be discharged; and rotating the actuator into the locked position so as to prevent the pivoting of the actuator into the open position.

* * * * *